US010094515B2

(12) United States Patent
Oldham et al.

(10) Patent No.: US 10,094,515 B2
(45) Date of Patent: Oct. 9, 2018

(54) NON-VENTING TRANSFER SYSTEM AND METHOD

(71) Applicant: Clean Energy Fuels Corp., Newport Beach, CA (US)

(72) Inventors: Kenny Oldham, Coalville, UT (US); Devin Martin, Evanston, WY (US)

(73) Assignee: CLEAN ENERGY FUELS CORP., Newport Beach, CA (US)

( * ) Notice: Subject to any disclaimer, the term of this patent is extended or adjusted under 35 U.S.C. 154(b) by 115 days.

(21) Appl. No.: 15/238,090

(22) Filed: Aug. 16, 2016

(65) Prior Publication Data

US 2016/0356423 A1 Dec. 8, 2016

Related U.S. Application Data

(62) Division of application No. 14/150,172, filed on Jan. 8, 2014.

(51) Int. Cl.
*F17C 7/02* (2006.01)

(52) U.S. Cl.
CPC ..... *F17C 7/02* (2013.01); *F17C 2221/033* (2013.01); *F17C 2223/013* (2013.01)

(58) Field of Classification Search
CPC ..... F17C 7/02; F17C 7/04; F17C 2223/013; F17C 2223/0153; F17C 2225/0161
See application file for complete search history.

(56) References Cited

U.S. PATENT DOCUMENTS

| | | | | |
|---|---|---|---|---|
| 5,511,955 | A * | 4/1996 | Brown | F04B 3/003 417/259 |
| 5,682,750 | A | 11/1997 | Preston et al. | |
| 6,382,240 | B1 | 5/2002 | MacDonald | |
| 6,622,758 | B2 * | 9/2003 | Drube | F17C 5/02 141/192 |
| 6,640,554 | B2 | 11/2003 | Emmer et al. | |
| 7,591,290 | B2 | 9/2009 | Bourgeois et al. | |
| 8,074,687 | B2 * | 12/2011 | Queau | F16L 39/005 138/109 |
| 2006/0218941 | A1 * | 10/2006 | Drube | F17C 5/02 62/50.2 |
| 2011/0114068 | A1 * | 5/2011 | Habing | F02D 41/0025 123/576 |
| 2011/0297273 | A1 | 12/2011 | Kempen et al. | |

OTHER PUBLICATIONS

Patent Cooperation Treaty, International Search report for PCT/US2015/010656, dated May 1, 2015, pp. 1-2.

* cited by examiner

*Primary Examiner* — Brian King
(74) *Attorney, Agent, or Firm* — Sheppard Mullin Richter & Hampton LLP

(57) ABSTRACT

The present invention provides non-venting transfer systems and methods related to transferring cryogenic liquid between two vessels without venting evaporated cryogenic liquid into the atmosphere. The stations, systems, and methods utilize a feed line and a return line connecting a source tank and a pump system to allow for flow of a cryogenic liquid to the pump and return of evaporated cryogenic liquid to the source tank, thereby avoiding release of the evaporated cryogenic liquid into the atmosphere.

8 Claims, 2 Drawing Sheets

NON-VENTING TRANSFER SYSTEM AND METHOD

CROSS REFERENCE TO RELATED APPLICATIONS

This application is a divisional application of U.S. patent application Ser. No. 14/150,172, filed Jan. 8, 2014, the content of which is incorporated herein by reference in its entirety.

FIELD OF THE INVENTION

The invention broadly relates to non-venting transfer systems and methods, and more particularly, some embodiments relate to transferring a cryogenic liquid with a sealed transfer system, i.e., without venting.

BACKGROUND OF THE INVENTION

Natural gas vehicles (NGVs) operate on the same basic principles as other internal combustion-powered vehicles. Fuel, in the form of natural gas, is mixed with air and fed into a cylinder where the mixture is ignited to move a piston up and down. Natural gas can power vehicles currently powered by gasoline and diesel fuels. However, at standard temperature and pressure, natural gas is a gas rather than a liquid. This gives rise to two types of NGVs, namely: those that are configured to use compressed natural gas (CNG); and those that are configured to operate on liquid natural gas (LNG).

In applications where weight and vehicle range are a concern, LNG is often the preferred fuel over CNG. Systems designed for storage and use of LNG operate at much lower pressures and can typically store as much as 2.5 times the fuel in the same space as conventional CNG systems.

However, to maintain and use LNG in a liquid state, the fuel must be transported and stored at cryogenic temperatures, typically with vacuum-insulated storage tanks. Refilling the cryogenic tanks is typically accomplished by transferring LNG from a transport vehicle and typically requires a significant amount of venting of natural gas in the process. Release of natural gas into the atmosphere is undesirable for a number of reasons. For instance, natural gas is highly flammable, and thus its release is a safety hazard. Natural gas is also a greenhouse gas. Finally, natural gas that is released is lost fuel, and thus lost revenue, for the LNG supplier.

SUMMARY OF THE INVENTION

Embodiments of the present invention provide non-venting transfer systems and methods. Some such embodiments entail cryogenic liquid dispensing stations, systems and methods related to transferring cryogenic liquid between two vessels without venting evaporated cryogenic liquid into the atmosphere. In particular embodiments, the cryogenic liquid may be LNG. Although the description below presents embodiments related to transferring LNG from a delivery vehicle to a LNG dispensing station, the disclosure is not intended to be limited to LNG. Additional embodiments of the invention are directed toward transport and/or non-fueling systems and methods.

One aspect of the invention is directed toward cryogenic liquid dispensing stations. These stations include a station cryogenic liquid tank; a pump with a pump suction line, a vapor return line, and a cryogenic liquid outflow line; a feed line; and a return line. The feed line comprises a cryogenic hose with two ends, the first end connected to the pump suction line, the second end terminating at a self-sealing nozzle. The return line comprises a cryogenic hose with two ends, the first end connected to the vapor return line, the second end terminating at a self-sealing nozzle. In these embodiments, the cryogenic liquid outflow line from the pump is connected to the station cryogenic liquid tank. Additionally, the feed and return line self-sealing nozzles are adapted to connect to a source cryogenic liquid tank. Finally, the pump is used to transfer cryogenic liquid from the source cryogenic liquid tank to the station cryogenic liquid tank.

In certain embodiments, the pump comprises a submersible cryogenic pump.

In some embodiments, the pump suction line comprises at least one valve capable of restricting liquid or gas flow through the pump suction line in at least one direction. In some embodiments, the pump suction line comprises at least one valve capable of restricting liquid or gas flow through the pump suction line in either direction. In further embodiments, the pump suction line comprises at least one valve capable of restricting liquid or gas flow through the pump suction line in one direction, such as from the pump into the hose. In additional embodiments, the pump suction line comprises at least two valves arranged in parallel, wherein one valve is capable of restricting liquid or gas flow through the pump suction line and either direction, and one valve is capable of restricting liquid or gas flow through the pump suction line in one direction, such as from the pump into the hose.

In some embodiments, the vapor return line comprises at least one valve capable of restricting liquid or gas flow through the vapor return line in at least one direction. In further embodiments, the vapor return line comprises at least one valve capable of restricting liquid or gas flow through the vapor return line in either direction. In additional embodiments, the vapor return line comprises at least one valve capable of restricting liquid or gas flow through the vapor return line in one direction, such as from the pump into the hose. In some embodiments, the vapor return line comprises at least two valves arranged in parallel, wherein one valve is capable of restricting liquid or gas flow through the vapor return line in either direction, and one valve is capable of restricting liquid or gas flow through the vapor return line in one direction, such as from the pump into the hose.

In certain embodiments, the cryogenic liquid dispensing station is a liquid natural gas (LNG) dispensing station.

A second aspect of the invention is directed to methods of transferring a cryogenic liquid from a source tank to a receiving tank without venting. The methods comprise connecting a receiving tank to a source tank via a pump system, the pump system comprising: a pump, an outflow line from the pump to the receiving tank, the outflow line comprising at least one valve capable of preventing flow of cryogenic liquid from the pump to the receiving tank, a pump suction line connected to a first cryogenic hose terminating with a self-sealing nozzle, and a vapor return line connected to a second cryogenic hose terminating with a self-sealing nozzle. In these embodiments, the vapor return line comprises at least one valve capable of preventing flow through the vapor return line from the pump to the second cryogenic hose. Additionally, connecting the receiving tank to the source tank comprises connecting the self-sealing nozzles of the first and second cryogenic hoses to the source tank. Further, in some embodiments, the pump system is initially at a first temperature above the boiling temperature of the cryogenic liquid. Once the receiving and source tanks are connected via the pump system, cryogenic liquid is flowed from the source tank to the pump system via the first cryogenic hose and flowing gas produced by evaporation of the cryogenic liquid at the pump system back to the source tank via the second cryogenic hose until the pump system is cooled to a second temperature at or below the boiling temperature of the cryogenic liquid; the vapor return line valve is configuring to prevent flow from the pump system to the source tank through the second cryogenic hose; the outflow line valve is configured to allow flow from the pump system to the source tank; and the pump is used to transfer cryogenic liquid from the source tank to the receiving tank.

In certain embodiments, the pump comprises a submersible cryogenic pump.

In some embodiments, the pump suction line comprises at least one valve capable of preventing liquid or gas flow through the pump suction line in at least one direction. In further embodiments, the pump suction line comprises at least one valve capable of preventing liquid or gas flow through the pump suction line in either direction. In additional embodiments, the pump suction line comprises at least one valve capable of preventing liquid or gas flow through the pump suction line in one direction, such as from the pump into the hose. In some embodiments, the pump suction line comprises at least two valves arranged in parallel, wherein one valve is capable of preventing liquid or gas flow through the pump suction line in either direction, and one valve is capable of preventing liquid or gas flow through the pump suction line in one direction, such as from the pump into the hose.

In some embodiments, the vapor return line valve is capable of preventing liquid or gas flow through the vapor return line in either direction. In further embodiments, the vapor return line further comprises a valve capable of preventing liquid or gas flow through the vapor return line in one direction, such as from the pump into the hose. In additional embodiments, the vapor return line comprises at least two valves arranged in parallel, wherein one valve is capable of preventing liquid or gas flow through the vapor return line in either direction, and one valve is capable of preventing liquid or gas flow through the vapor return line in one direction, such as from the pump into the hose.

In certain embodiments, the cryogenic liquid dispensing station is a liquid natural gas (LNG) dispensing station.

DETAILED DESCRIPTION

Figure 1:
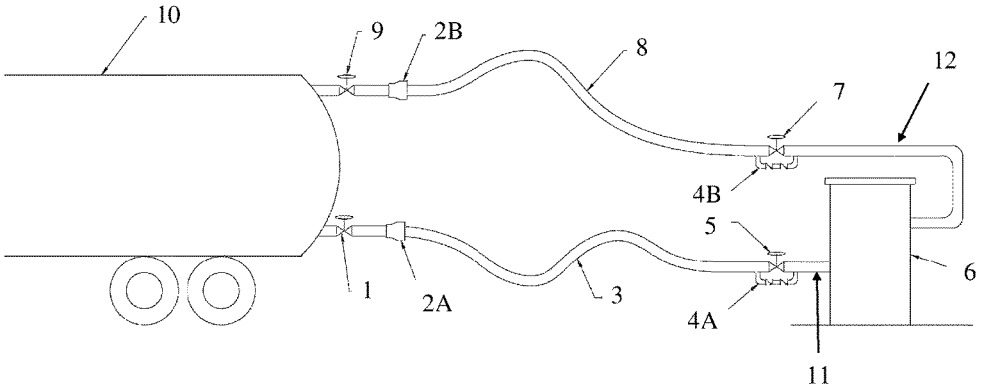
FIG. 1 is an illustration of a transfer vehicle attached to an exemplary pump system configured to perform a liquid transfer without venting according to one method described herein.

In the following paragraphs, the present invention will be described in detail by way of example with reference to the attached drawing. Throughout this description, the preferred embodiment and examples shown should be considered as exemplars, rather than as limitations on the present invention. As used herein, the "present invention" refers to any one of the embodiments of the invention described herein, and any equivalents. Furthermore, reference to various feature(s) of the "present invention" throughout this document does not mean that all claimed embodiments or methods must include the referenced feature(s).

Various embodiments of the invention are directed toward non-venting transfer systems and methods. Some embodiments involve cryogenic liquid dispensing stations, systems and methods related to transferring cryogenic liquid between two vessels without venting evaporated cryogenic liquid into the atmosphere. Additional embodiments are directed toward transport and/or non-fueling systems and methods.

As discussed above, LNG is the preferred fuel in some NGV applications. In such instances, cryogenic refueling stations are required for storage and dispensing LNG. These refueling stations are typically refilled by transferring LNG from a transfer vehicle such as a transport vehicle and typically requires a significant amount of venting of natural gas in the process.

For instance, a typical transfer process may proceed as follows: a cryogenic hose of sufficient diameter is initially connected via appropriate fittings to the transfer vehicle and a pump located external to, but in fluid communication with, the receiving tank. The pump and cryogenic hoses begin the process at a first temperature above the boiling point of the cryogenic liquid. A feed valve at or near the hose connection to the transfer vehicle is then opened allowing fluid communication between the transfer vehicle tank and the hose. Cryogenic liquid initially flows into the hose toward the pump, but evaporates rapidly as it contacts the much warmer hose. When sufficient pressure has developed via this evaporation, LNG flow into the hose stops. A bleed valve at or near the hose connection to the pump is then opened, allowing the evaporated LNG to escape into the atmosphere, and allowing continuation of the flow of cryogenic liquid into the hose. This step serves two purposes, specifically: (i) to reduce the temperature of the hose to a temperature at or below the boiling point of the cryogenic liquid, and (ii) to purge the hose of air prior to LNG transfer so as to avoid introduction of oxygen and other gaseous impurities into the receiving tank.

Once the hose has been cooled and purged, the bleed valve is closed and a station fill valve between the hose and pump is opened, allowing fluid communication between the transfer vehicle and the pump. At this point, the pump is at or near ambient temperature and, like the hose, must be cooled to a temperature at or below the LNG boiling temperature before LNG can be transferred to the receiving tank. However, the pressure in the pump pot and transport trailer quickly equalize, thus preventing spontaneous flow of LNG into the pump pot.

A pump pot vent is opened to allow LNG to flow into and cool the pump pot. LNG then flows into the pump pot, evaporates, and vents into the atmosphere until the pump pot is sufficiently cool. The cooling process typically takes approximately 10 minutes, with natural gas venting into the atmosphere the entire time. Release of natural gas into the atmosphere is generally undesirable. Additionally, this process typically has a further complication in that the only indication that the pump pot has sufficiently cooled and is full of LNG comes from the vent line. When LNG starts to flow through the vent line, the noise of the escaping gas typically changes pitch. If this audible signal is missed by the operator, natural gas is soon expelled from the vent as LNG. Again, this loss of LNG is a safety hazard for the operator and is lost fuel, and thus lost revenue, for the LNG supplier. Once the pump pot has sufficiently cooled and is filled with LNG, the vent valve is closed and the pump is turned on to transfer LNG into the receiving tank.

When the transfer is complete, the operator closes the transport feed and station fill valves. The bleed valve is again opened to vent LNG remaining in the hose. This is another source of lost LNG, as well as another potential safety hazard. The safety hazard may be particularly exasperated if the operator disconnects the hose at either end before the LNG has completely evaporated and vented from the hose. If this occurs, LNG freely flows from the hose onto the ground. When the hose is finally empty, it can be detached from both the transport and station and be stored.

As will be appreciated, the process described above allows for, and even requires, the release of natural gas into the environment. Methods and systems described herein differ at least in that release of natural gas into the environment is significantly reduced if not substantially eliminated. To accomplish this reduction, systems and methods described herein utilize at least a cryogenic pump with a pump suction line, a vapor return line, and a cryogenic liquid outflow line; and two cryogenic hoses.

Both cryogenic hoses are connected to one of the pump lines at one end and are equipped with a self-sealing nozzle at the other. The self-sealing nozzles are configured to attach to a source cryogenic liquid tank (e.g., such as found on a transport vehicle). One of the hoses is used for inflow of cryogenic liquid into the cryogenic liquid station via connection to a pump suction line of the pump system. The other hose is used for return flow of evaporated cryogenic liquid to the source cryogenic liquid tank, and is connected to a vapor return line of the pump. In this configuration, it is intended that once attached and initially purged, the hoses remain attached to the cryogenic liquid station (i.e., to the suction and vapor return lines of the pump, respectively). The self-sealing nozzles prevent introduction of air into the hoses between fillings, thus eliminating the need to purge the hoses at every fill. The pump also comprises a third line (a cryogenic liquid outflow line) in fluid communication with the receiving tank.

In some embodiments, one or more of the suction line, vapor return line, and cryogenic liquid outflow line are equipped with a valve that allows flow of cryogenic liquid or evaporated gas (e.g., LNG or natural gas) in either direction through the valve when the valve is open, but prevents flow in either direction when the valve is closed.

In some embodiments, one or more of the suction line, vapor return line, and cryogenic liquid outflow line are equipped with a check valve, i.e., a passive valve that allows flow of cryogenic liquid or evaporated gas (e.g., LNG or natural gas) in one direction through the valve but prevents flow in the other direction. In some embodiments, the check valves are circle check valves. In some embodiments, check valves are disposed between the pump suction line and/or vapor return line and the cryogenic hoses attached thereto. In these embodiments, a check valve is disposed such that cryogenic liquid or evaporated gas remaining in a hose after the transfer is complete and the pump is switched off can flow into the pump through the check valve, but cryogenic liquid or evaporated gas remaining in the pump is prevented from flowing into the hoses through the check valve.

In some embodiments, one or more of the suction line and vapor return line are equipped with a plurality of valves in a parallel configuration, such that all valves in the plurality are disposed so as to be connected to the same pump line on one side of the valves, and the same cryogenic hose on the other side of the valves. In these embodiments, one of the plurality of valves allows flow of cryogenic liquid or evaporated gas (e.g., LNG or natural gas) in either direction through the valve when the valve is open, but prevents flow in either direction when the valve is closed. Another of the plurality of valves is a check valve disposed such that cryogenic liquid or evaporated gas remaining in the hose after the transfer is complete and the pump is switched off can flow into the pump through the check valve, but cryogenic liquid or evaporated gas remaining in the pump is prevented from flowing into the hoses through the check valve.

Certain systems described herein may further comprise one or more of the following components: a process pump assembly; a cryogenic liquid dispenser; a vaporizer; an electronic control system; an air purge system; one or more skids configured for receiving and holding the cryogenic receiving tank, and any other component or subsystem that would be understood in the art to be used in cryogenic liquid dispensing systems, particularly LNG fuelling stations, such as additional dispenser assemblies or additional process pump assemblies.

An exemplary non-venting method of transferring LNG (a cryogenic liquid) is described below. This example is not intended to be limiting to LNG or to the particular system components described below, particularly as only the system components affecting the non-venting transfer are described in detail. As indicated above, the systems described herein may further comprise a variety of components or subsystems that would be understood in the art to be used in cryogenic liquid dispensing systems, particularly LNG fuelling stations.

In an exemplary non-venting transfer method, the cryogenic hoses are already connected to the station and, due to the sealable nozzles, contain no air. First, a feed line (the cryogenic hose connected to the pump suction line) is attached via appropriate fittings to the transfer vehicle, preferably at a location at or near the bottom of a transfer vehicle's LNG tank. Likewise, a return line (the cryogenic hose connected to the vapor return line of the pump) is attached via appropriate fittings to the transfer vehicle, preferably at a location at or near the top of the transfer vehicle's LNG tank. The operator then opens valves located at the station and the transport vehicle for each of the feed and return lines. Note that because the feed and return lines contain no air, no venting is necessary to purge the lines.

The feed and return lines now establish a closed system allowing LNG to flow to the pump pot from the transfer vehicle and allow for return of vaporized natural gas from the pump vapor line back to the transport vehicle. LNG is allowed to flow to the pump in this system configuration until the pump pot is sufficiently cooled (i.e., cooled to a temperature at or below the boiling point of the cryogenic liquid). Again, note that no natural gas or LNG is released to the atmosphere during this step. Once the pump has sufficiently cooled and is filled with LNG, the return line valves are closed and the pump is turned on to transfer LNG into the receiving tank.

When the transfer is complete, the operator closes the feed line valves, disconnects both the feed line and return line from the transfer vehicle, and returns the hoses to their storage locations at the station. Again, due to the self-sealing nozzles on the ends of the feed and return lines, no venting of the hoses is required. In some embodiments, residual LNG (and natural gas, as the LNG evaporates) in the feed and return lines may flow into the pump through check valves placed in parallel with the station feed and return valves, as described above.

A simplified overview of an exemplary system, including exemplary locations of certain optional design features described above is shown in FIG. 1. Specifically, a transfer vehicle 10 is shown with feed line 3 and return line 8 attached thereto. Feed line 3 is attached to the transfer vehicle at a location at or near the bottom of the transfer vehicle's LNG tank 10 via a self-sealing nozzle 2A. The transfer vehicle also has feed line valve 1 to regulate flow of LNG from the transfer vehicle. Similarly, return line 8 is attached to the transfer vehicle at a location at or near the top of the transfer vehicle's LNG tank 10 via a self-sealing nozzle 2B. The transfer vehicle also has return line valve 9 to regulate return flow of natural gas to the transfer vehicle.

At the station, feed line 3 is shown attached to the suction line 11 of pump pot 6. Two parallel valves are seen at this connection: feed line valve 5 and a check valve 4A. Check valve 4A is configured so as to allow LNG and evaporated natural gas in the feed line 3 to flow into the pump pot 6, but prevent flow in the other direction. Similarly, return line 8 is shown attached to the vapor return line 12 of pump pot 6. Two parallel valves are also seen at this connection: return line valve 7 and a check valve 4B. Check valve 4B is also configured so as to allow LNG and evaporated natural gas in the return line 8 to flow into the pump pot 6, but prevent flow in the other direction.

Figure 2:
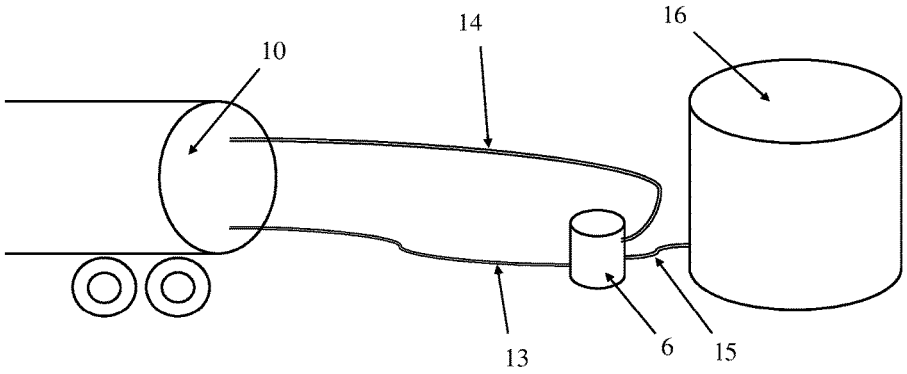
FIG. 2 is an illustration of an exemplary system configured to perform a liquid transfer from a transfer vehicle cryogenic tank to a receiving tank via a pump without venting.

Note that additional components are not shown in FIG. 1, including a receiving tank, and a LNG outflow line from pump pot 6 in fluid communication with the receiving tank. These components, however, are seen in FIG. 2. Specifically, FIG. 2 shows a transfer vehicle's LNG tank 10 connected to a pump system 6 via a feed line/pump suction line 13 and return line/vapor return line 14 (the details of the connections and valves used in these lines are not shown but can be any suitable configuration as described above). The pump system 6 is connected to the receiving tank 16 via a LNG outflow line 15.

While various embodiments of the present invention have been described above, it should be understood that they have been presented by way of example only, and not of limitation. Likewise, the various diagrams may depict an example architectural or other configuration for the invention, which is done to aid in understanding the features and functionality that may be included in the invention. The invention is not restricted to the illustrated example architectures or configurations, but the desired features may be implemented using a variety of alternative architectures and configurations. Indeed, it will be apparent to one of skill in the art how alternative functional, logical or physical partitioning and configurations may be implemented to implement the desired features of the present invention. Also, a multitude of different constituent module names other than those depicted herein may be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead may be applied, alone or in various combinations, to one or more of the other embodiments of the invention, whether or not such embodiments are described and whether or not such features are presented as being a part of a described embodiment. Thus the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, may be combined in a single package or separately maintained and may further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives may be implemented without confinement to the illustrated examples. For example, block diagrams and their accompanying description should not be construed as mandating a particular architecture or configuration.

The invention claimed is:

1. A method of transferring a cryogenic liquid from a source tank to a receiving tank without venting, the method comprising:

connecting a receiving tank to a source tank via a pump system, the pump system comprising:

a pump, an outflow line connected to the receiving tank, the outflow line comprising at least one valve capable of preventing flow of cryogenic liquid from the pump to the receiving tank, a pump suction line connected to a first cryogenic hose terminating with a self-sealing nozzle, and a vapor return line connected to a second cryogenic hose terminating with another self-sealing nozzle, the vapor return line comprising at least one valve capable of preventing flow through the vapor return line to the second cryogenic hose;

wherein connecting the receiving tank to the source tank comprises connecting the self-sealing nozzles of the first and second cryogenic hoses to the source tank, and wherein the pump system is initially at a first temperature above the boiling temperature of the cryogenic liquid;

flowing cryogenic liquid from the source tank to the pump system via the first cryogenic hose and flowing gas produced by evaporation of the cryogenic liquid at the pump system back to the source tank via the second cryogenic hose until the pump system is cooled to a second temperature at or below the boiling temperature of the cryogenic liquid;

configuring the vapor return line valve to prevent flow from the pump system to the source tank through the second cryogenic hose;

configuring an outflow line valve to allow flow from the pump system to the source tank; and using the pump to transfer cryogenic liquid from the source tank to the receiving tank.

2. The method of claim 1, wherein the pump comprises a submersible cryogenic pump.

3. The method of claim 1, wherein the pump suction line comprises at least one valve capable of preventing liquid or gas flow through the pump suction line in at least one direction.

4. The method of claim 1, wherein the pump suction line comprises at least one valve capable of preventing liquid or gas flow through the pump suction line.

5. The method of claim 1, wherein the pump suction line comprises at least one valve capable of preventing liquid or gas flow through the pump suction line in one direction.

6. The method of claim 1, wherein the pump suction line comprises at least two valves arranged in parallel, wherein one valve is capable of preventing liquid or gas flow through the pump suction line, and one valve is capable of preventing liquid or gas flow through the pump suction line in one direction.

7. The method of claim 1, wherein a vapor return line valve is capable of preventing liquid or gas flow through the vapor return line.

8. The method of claim 1, wherein the vapor return line valve is capable of preventing liquid or gas flow through the vapor return line.

* * * * *